United States Patent [19]

Asick

[11] 4,386,814

[45] Jun. 7, 1983

[54] KIT FOR CONVERTING A PANEL OPENING TO A SHIELDED PIN RECEPTACLE

[75] Inventor: John C. Asick, Harrisburg, Pa.

[73] Assignee: AMP Incorporated, Harrisburg, Pa.

[21] Appl. No.: 293,058

[22] Filed: Aug. 17, 1981

[51] Int. Cl.[3] ..... H01R 4/66

[52] U.S. Cl. ..... 339/14 R; 339/17 LC; 339/143 R

[58] Field of Search ..... 339/14 R, 17 L, 17 LC, 339/136 R, 138, 141, 143 R, 126 R, 17 F; 174/35 C

[56] References Cited

U.S. PATENT DOCUMENTS

| | | | |
|---|---|---|---|
| 2,169,962 | 8/1939 | Del Camp | 339/143 R |
| 3,056,942 | 10/1962 | Carbaugh et al. | 339/92 |
| 3,128,138 | 4/1964 | Noschese | 339/14 R |
| 3,366,918 | 1/1968 | Johnson et al. | 339/143 R |
| 3,871,735 | 3/1975 | Herrmann | 339/177 R |
| 3,922,056 | 11/1975 | Murawski | 339/143 R |
| 4,111,513 | 9/1978 | Thurston et al. | 339/143 R |
| 4,148,543 | 4/1979 | Shores | 174/35 C |
| 4,243,288 | 1/1981 | Lucius et al. | 339/99 R |

OTHER PUBLICATIONS

"Cable Connector with Intergal Grounding Means", Uberbacher, E. C., IBM Tech. Disclosure Bulletin, vol. 23, No. 9, pp. 4242–4243, Feb. 1981.

*Primary Examiner*—Eugene F. Desmond
*Assistant Examiner*—David Pirlot
*Attorney, Agent, or Firm*—Russell J. Egan

[57] ABSTRACT

A kit is disclosed for converting a standard connector opening in a panel or the like into a shielded pin receptacle. The kit includes a ground plane spring and a shielded header shroud. The spring is a planar metal member having spring fingers on the outer periphery and a central opening conforming to the panel opening. A plurality of integral inwardly directed tines surround the central opening and extend substantially normal to the spring. The shroud is formed of insulative material with a cavity profiled to receive both the tines and a mating connector. An array of openings in the bottom of the cavity permit insertion of pin terminals from a pin header, pin connector or the like.

7 Claims, 8 Drawing Figures

KIT FOR CONVERTING A PANEL OPENING TO A SHIELDED PIN RECEPTACLE

The present invention relates to a kit which can be used in cooperation with known panel mounted electrical connectors to convert the known connector to interface with a shielded mating connector providing proper shielding at the mating face.

The development of highly sophisticated electronic equipment has created requirements for shielding in order to prevent cross-talk from occurring within the equipment. An effective way of accomplishing this cross-talk prevention is to utilize shielded cable and connectors. While such shielding is necessary when making interconnections between components, it is not necessary to have shielding for connections within a component or unit casing itself. It is highly desirable to be able to adopt existing connectors of the type that are commonly used in such components to enable them to make a shielded interconnection with a shielded connector and cable.

According to the present invention, therefore, a kit as defined above is characterized in that it comprises a ground plane spring formed from a planar metal member having a plurality of spring fingers extending radially outwardly therefrom, for making a good connection to a metal panel, and a plurality of spring tines extending normal to the plane of the spring from the periphery from a central opening. At least one of the tines is staggered so as to provide polarization of the opening. A shielded header shroud of insulative material has a central cavity directed to one side thereof and a plurality of apertures in a patterned array opening into the cavity from the opposite side. Means are provided to mount the shielded header shroud and ground plane spring against a panel with the central opening of the ground plane spring surrounding an opening in the panel and the tines thereof extending into the cavity of the shroud. A known pin assembly is joined with the kit, the pin terminals thereof extending through the patterned array of apertures and engaging a known shielded connector entering through the opening of the panel.

An embodiment of the present invention will now be described by way of example with reference to the accompanying drawings in which:

FIG. 5 is a vertical transverse section through the subject invention mated with the shielded connector of FIG. 1 and a right angle header on a circuit board or the like;

Figures 1, 2:
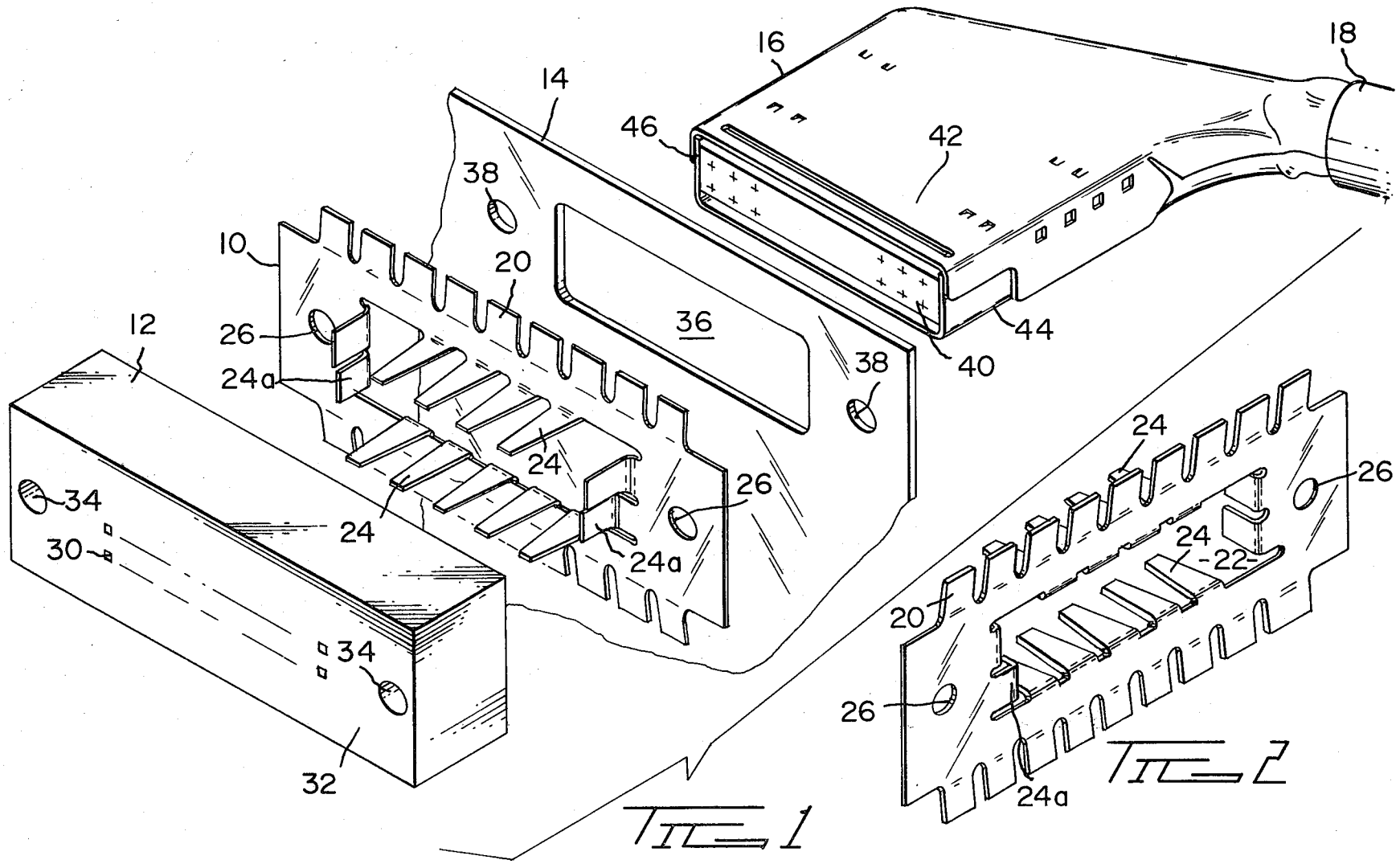
FIG. 1 is an exploded perspective view of the subject invention together with a fragment of a panel and a mating shielded electrical connector.
FIG. 2 is a perspective view of the ground plane spring of the present invention.

The present invention is comprised of a kit formed by a metal ground plane spring 10 and a shielded header shroud 12 of insulative material. The spring 10 and shroud 12 are used in combination with a panel 14 and a shielded electrical connector 16 terminating a shielded cable 18.

The ground plane spring 10 is a metal member preferably having a plurality of outwardly directed peripherial fingers 20, a central opening 22, and a plurality of integral tines 24 about the periphery of the opening 22 and extending substantially normal to the plane of the spring 10. At least one of the tines **24*a* is offset with respect to the periphery of the opening 22 to form a keyed or polarized entry, as best seen in FIG. 2. The ground plane spring also includes mounting apertures 26**.

Figure 3:
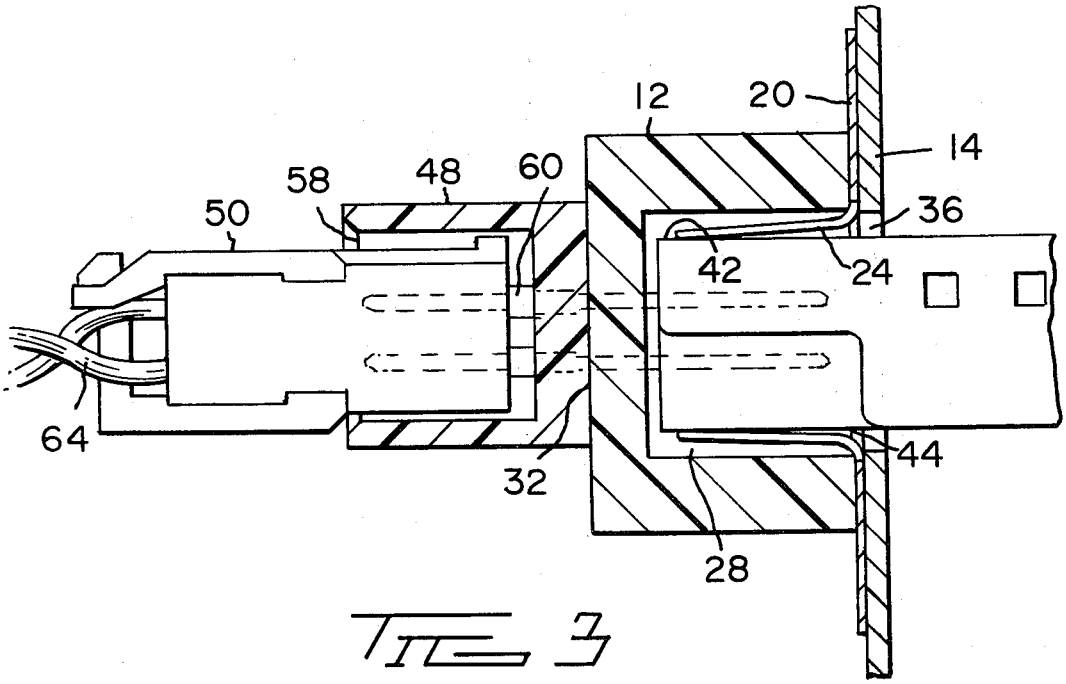
FIG. 3 is a vertical transverse section through the kit of the present invention mated with the shielded connector of FIG. 1 and a known pin header and connector.

The shielded header shroud 12 is an elongated member of insulative material having a central cavity 28 (FIG. 3). An array of apertures 30 extend through the base 32 of the shroud to enter the cavity 28. The shroud also includes mounting holes 34 aligned with the holes 26 of the ground plane spring 10. The cavity 28 is of sufficient size and shape to receive the tines 24 of the ground plane spring 10 therein.

The panel 14 is a portion of a standard metal equipment enclosure (not shown) and is provided with an elongated aperture 36 and flanking mounting apertures 38.

The mating connector 16 is preferably of the type disclosed in U.S. patent application No. 154,162, the disclosure of which is incorporated herein by reference. It should be noted that this connector has a terminal carrying module 40 enclosed in a pair of mating metal shells 42, 44 which together, due to their overlap, provide a profiled mating face 46.

Figure 4:
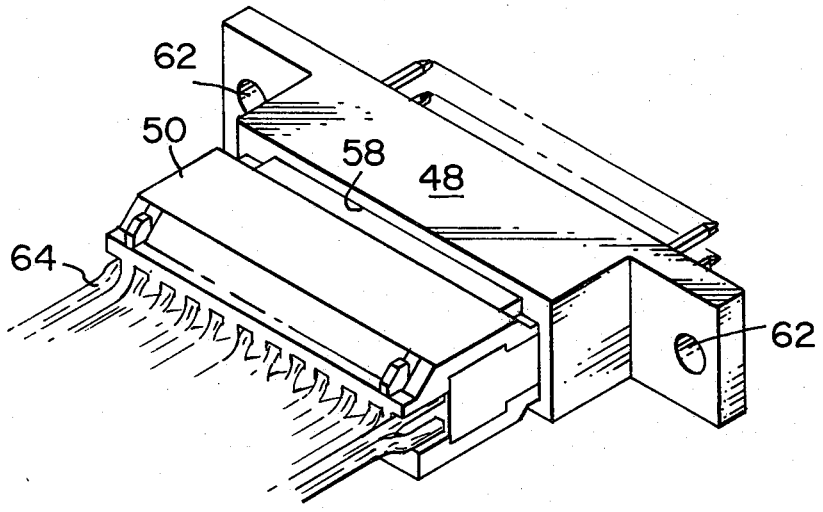
FIG. 4 is a perspective view of the pin header and connector of FIG. 3.
Figure 5:
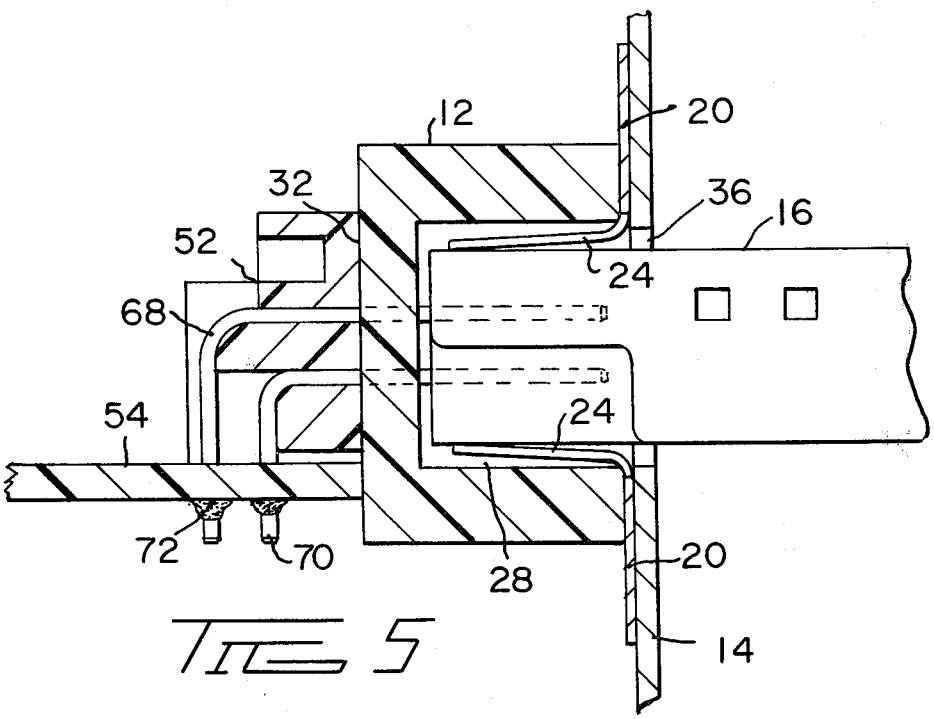
Figure 6:
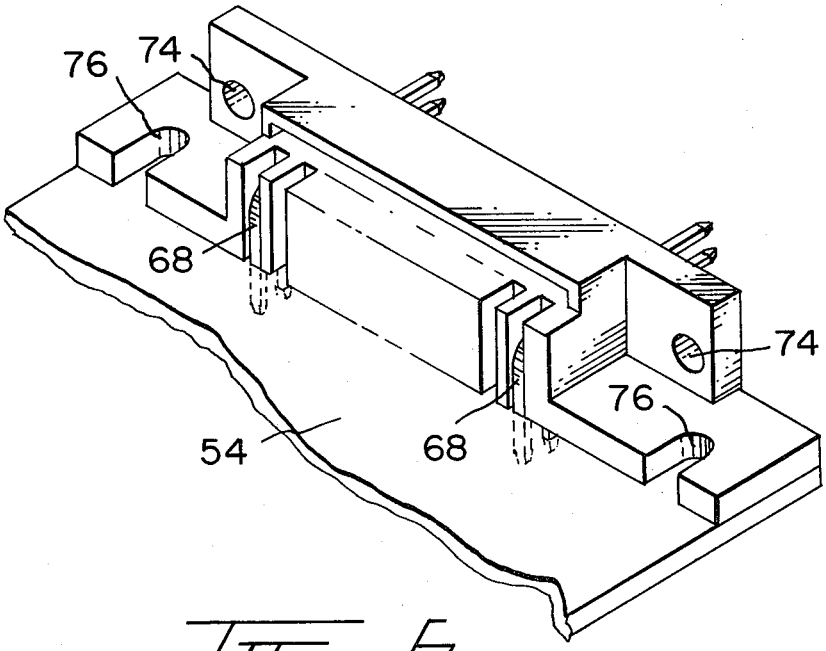
FIG. 6 is a perspective view of the header and circuit board of FIG. 5.
Figure 7:
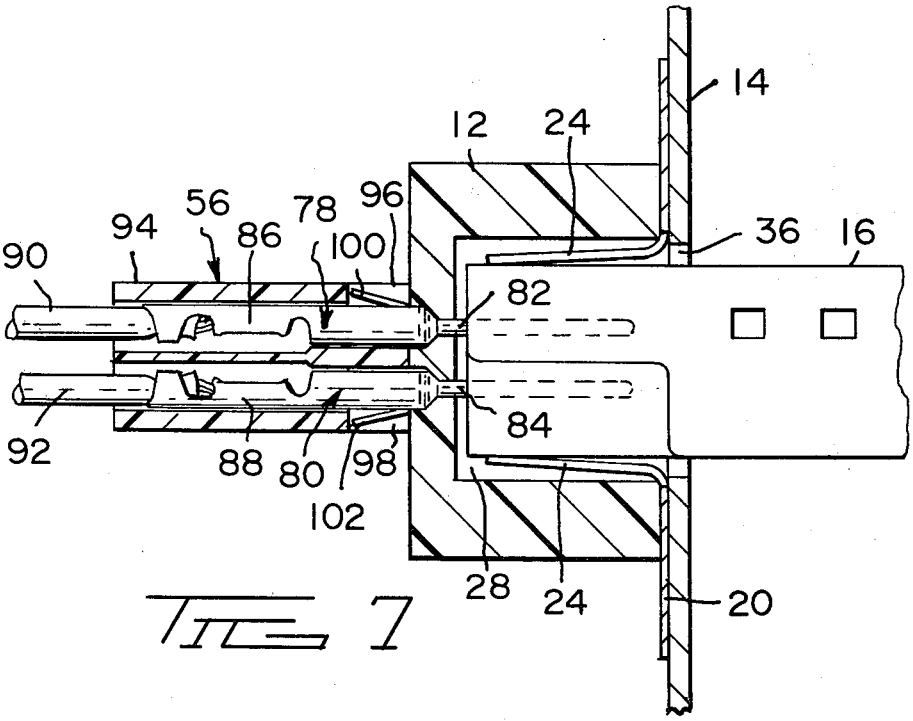
FIG. 7 is a vertical transverse section through an assembly of the present invention with the shielded connector of FIG. 1 and a one-piece housing pin connector terminating a plurality of conductors.
Figure 8:
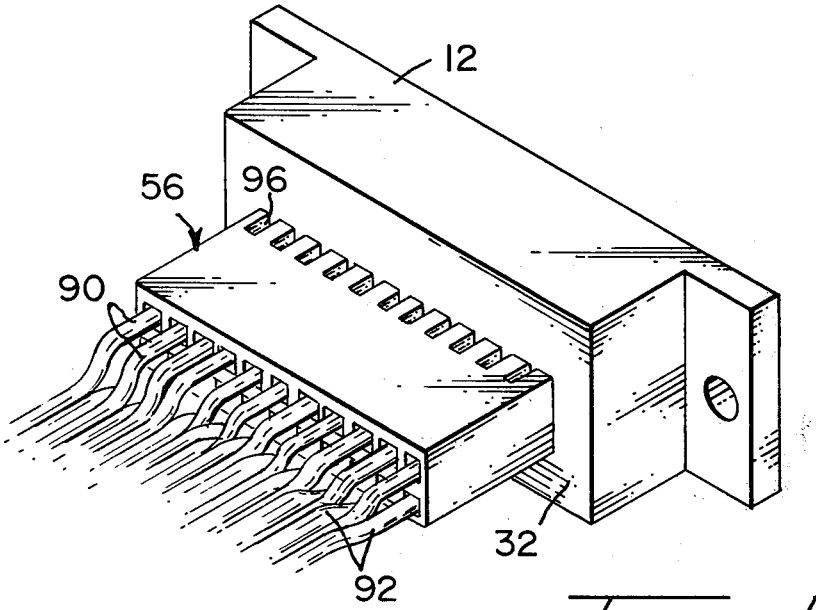
FIG. 8 is a perspective view of the assembly of FIG. 7.

A mating portion for the connector 16 is provided by either a pin header 48 and connector 50, as shown in FIGS. 3 and 4, a right angle header 52 on a circuit board 54, as shown in FIGS. 5 and 6, or a pin connector 56 as shown in FIGS. 7 and 8.

The header 48 of FIGS. 3 and 4 is an insulative member having an overall profile similar to that of the shielding header shroud 12 with a central cavity 58 and a plurality of pin terminals 60 mounted therein extending through the apertures 30 of the shroud 12 and with mounting apertures 62 aligned with the mounting apertures 34, 26, and 38. The mating connector 50 terminates a plurality of individual conductors 64, which can also be in the form of a ribbon cable and the connector is preferably of the type disclosed in U.S. Pat. No. 4,243,288, the disclosure of which is incorporated herein by reference.

The header 52 of FIGS. 5 and 6 is a right angle header having rows of pin terminals 68, 70 aligned to be received in the apertures 30 of the shroud 12 and to be received in similar apertures in circuit board 54 being secured to the circuit board by solder 72 or other conventional means. The header 52 would also, preferably, have mounting apertures 74 for attaching it to the shroud 12 and further mounting recesses 76 for securing it to the circuit board 54 by known means (not shown).

The pin connector 56 of FIGS. 7 and 8 is here illustrated as a two row connector having two rows of pin terminals 78, 80 each of which has a pin portion 82, 84 of sufficient length to extend through the apertures 30 in the shroud 12 as well as portions 86, 88 to crimping engage respective conductors 90, 92. The connector 56 also includes a housing 94 of rigid insulative material having apertures 96, 98 in which locking lances 100, 102 of the respective terminals 78, 80 protrude.

In each instance the operation of the subject invention is quite similar. The ground plane spring 10 is placed against the panel 14 with the mounting apertures 26, 38 in alignment and the shroud 12 is placed over the ground plane spring 10 with the tines 24 extending into the cavity 28 of the shroud. For the embodiments of FIGS. 5-8, the pin headers 48, 52 would be joined to the panel 14, spring 10, shroud 12 assembly with the mounting holes 38, 26, 34, 62, 74 aligned and secured together by conventional means (not shown). The mating connector 50 of FIGS. 3 and 4 could just be applied to this assembly and the shielded connector 16 mated therewith. The pin terminals 60 of pin header 48 extend in both directions to lie within the cavity 28 of the shroud 12 as well as within the cavity 54 of the header and make interconnection between connectors 16 and 50. The pin header 52 of FIGS. 5 and 6 is permanently secured to circuit board 54. The pin terminals 68, 70 of header 52 would extend through apertures 30 of the shroud 12 where they would lie in cavity 28 so as to be accessible for mating with shielded connector 16.

The embodiment of FIGS. 7 and 8 would need no further assembly beyond panel 14, spring 10 and shroud 12. This assembly could be secured together and connector 56 applied with pin portions 82, 84 of the terminals 78, 80 extending through apertures 30 to be mateable with shielded connector 16.

It should be noted that the metal shells 42, 44 of the shielded connector 16 at least partly overlap to give a profile to the mating face 46. At last one tine **24*a* of the spring 10 is offset from the other tines 24 to define a profiled and/or polarized opening for receiving the shielded connector 16**.

I claim:

1. A kit for converting a connector receiving aperture in a panel or the like to a shielded pin receptacle, comprising:

a metal ground plane spring having a plurality of outwardly directed spring fingers, a central opening and a plurality of tines directed toward said opening and extending at substantially right angles to the plane of said spring, and means to mount said spring on said panel; and a shroud of insulative material having a central cavity profiled to receive the tines of said spring therein, a patterned array of apertures in the bottom of said cavity, and means for mounting said shroud on said panel, whereby a shielded connector can be accepted through said panel in wiping engagement with said tines of said spring to effect grounding of said shielding to said panel and engage pin terminals entering said shroud cavity through the apertures thereof.

2. A kit according to claim 1 further comprising:

a pin header having a plurality of pin terminals therein in a patterned array, one end of each said pin terminal being received through said apertures in said shroud so as to be accessible for mating with said shielded connector.

3. A kit according to claim 2 wherein said pin header has one planar face for engaging said shroud and an oppositely directed face enclosed in a hood defining a pin receptacle.

4. A kit according to claim 2 wherein said pin header has one planar face for engaging said shroud and a mating face for engaging a circuit board, said pin terminals extending from both said faces.

5. A kit according to claim 4 wherein said faces are normal to each other.

6. A kit according to claim 1 wherein at least one of said tines is inwardly offset whereby said central opening is profiled and polarized.

7. In combination with a connector receiving aperture in a panel or the like, a kit for converting said connector receiving aperture to a shielded pin receptacle, mateable with connectors on both sides of said panel, said kit comprising:

a metal ground plane spring having a plurality of outwardly directed spring fingers, a central opening of substantially the same profile as said aperture and a plurality of tines extending into said opening and bent at substantially right angles to extend from the plane of said spring, and means to mount said spring on said panel with said opening aligned with said aperture;

a shroud of insulative material having a central cavity directed toward said spring and profiled to receive the tines of said spring therein, a patterned array of holes in the bottom of said cavity, and means for mounting said shroud on said panel with said spring therebetween; and a plurality of pin terminals in fixed array, each said pin terminal having a first end extending through a respective hole in said shroud and a second end engageable with a conductor;

whereby said pin terminals, shroud, and spring form a pin receptacle on one side of said panel receiving a shielded connector therein with the tines of said spring making a grounding connection between said panel and said shielded connector and said pin terminals engage terminals carried by said shielded connector.

* * * * *